US005408157A

United States Patent [19]

Alderman et al.

[11] Patent Number: 5,408,157

[45] Date of Patent: Apr. 18, 1995

[54] DUAL ARC TUBE DISCHARGE LAMP HAVING A LAMP FRAME WITH COPLANAR SPOT WELDS AND SLIP-FREE CONSTRUCTION

[75] Inventors: John C. Alderman, Corning; Kathleen P. Bernard, Painted Post; Louis B. Dubowicz, Bath; Edward A. Putnam, Campbell; Norman King, Hammondsport, all of N.Y.

[73] Assignee: North American Philips Corporation, New York, N.Y.

[21] Appl. No.: 28,466

[22] Filed: Mar. 9, 1993

[51] Int. Cl.[6] ..... H01J 1/02

[52] U.S. Cl. ..... 313/25; 313/1; 313/238; 313/252; 313/284; 313/285; 313/292; 313/623; 313/624

[58] Field of Search ..... 313/25, 285, 252, 284, 313/634, 238, 623, 292, 1

[56] References Cited

U.S. PATENT DOCUMENTS

| | | | |
|---|---|---|---|
| 2,103,029 | 9/1936 | Davies | 176/122 |
| 3,409,790 | 11/1968 | Gottschalk | 313/25 |
| 3,882,346 | 5/1973 | McVey | 313/25 |
| 4,287,454 | 9/1981 | Feuersanger et al. | 315/178 |
| 4,321,506 | 3/1982 | Tsuchihashi et al. | 315/35 |
| 4,689,518 | 8/1987 | King | 313/1 |
| 4,751,432 | 6/1988 | Van Delm | 315/178 |
| 4,788,475 | 11/1988 | Jacobs | 315/183 |
| 4,800,321 | 1/1989 | Ike et al. | 313/634 |
| 4,868,449 | 9/1989 | Dunn et al. | 313/25 |
| 4,906,888 | 3/1990 | Dunn et al. | 313/25 |
| 4,958,103 | 10/1990 | Jacobs et al. | 313/25 |
| 5,028,845 | 7/1991 | Ravi et al. | 315/189 |
| 5,173,632 | 12/1992 | Dolan et al. | 313/25 |

FOREIGN PATENT DOCUMENTS

| | | |
|---|---|---|
| 3112048 | 5/1991 | Japan . |
| 926045 | 5/1963 | United Kingdom . |

*Primary Examiner*—Donald J. Yusko
*Assistant Examiner*—Ali Horri
*Attorney, Agent, or Firm*—Brian J. Wieghaus

[57] ABSTRACT

A high pressure discharge lamp includes a pair of arc tubes connected electrically in parallel within an outer envelope, which includes a lamp stem having a pair of stem conductors entering the lamp envelope in a common plane. The arc tubes include conductive feed-throughs at each end thereof. A lamp frame supports the arc tubes in a plane parallel with the stem conductors and is welded directly to each of the feed-throughs with all welds in a common plane with the welds between the frame and the stem conductors. The frame includes a resiliently deformable transverse member which allows for independent changes in length of the arc tubes during lamp operation due to thermal expansion/contraction. The frame is free of slip fit connections with the feed-throughs and free of additional conductive straps connected to the feed-throughs.

15 Claims, 2 Drawing Sheets

DUAL ARC TUBE DISCHARGE LAMP HAVING A LAMP FRAME WITH COPLANAR SPOT WELDS AND SLIP-FREE CONSTRUCTION

BACKGROUND OF THE INVENTION

The invention relates to a high pressure metal vapor discharge lamp having an outer envelope, a lamp stem sealing said outer envelope in a gas-tight manner and including a pair of stem conductors extending within said outer envelope in a common plane, a pair of arc tubes each having a ceramic wall enclosing a discharge space, pair of metallic feed-throughs extending from each end thereof, and a discharge sustaining fill in said discharge space, and a metallic lamp frame for supporting said arc tubes within said outer envelope and electrically connecting said arc tubes in parallel, said frame being electrically connected to each of said metallic arc tube feed-throughs.

Such a lamp is known, for example, from U.S. Pat. Nos. 4,868,499 and 4,906,888 (Dunn et al) and U.S. Pat. No. 4,287,454 (Feuersanger et al) which disclose a dual arc tube high pressure sodium discharge lamp. In each of these lamps the lamp frame supports the arc tubes longitudinally within the envelope and aligned with each other in a plane transverse to the plane extending through the stem conductors.

Because of the electrically parallel configuration, a discharge is maintained in only one of the arc tubes during lamp operation. If the one arc tube is extinguished during operation, for example due to an interruption in the power supply, the other arc tube will ignite first upon restoration of power to the lamp because of its lower temperature. The arc tube which was previously operating will remain off. Thus, during operation the arc tubes will have different lengths due to thermal expansion because one of the arc tubes will be at a higher temperature. Additionally, their lengths will change upon switching the lamp on and off.

In these lamps, the frame includes a member which is welded directly to the metallic feed-throughs at one end of the arc tubes. At the other end of the arc tubes, the frame includes a stabilizing member which includes a portion inserted into each of the tubular feed-throughs with a slip fit. The slip fit allows for changes in length of the ceramic arc tubes independently of each other due to the above-mentioned thermal expansion. To ensure a good electrical connection with the feed-throughs which have the slip-fit with the stabilizing member, additional flexible conductors in the form of straps or wires are welded to the stabilizing member and these feed-throughs.

The frames for the above lamps are rather complex and include numerous metallic frame parts which must be accurately positioned and welded together. Since the frame components extend in three dimensions, the welds which connect the frame to the feed-throughs are spaced in a plane which is transverse to the welds which connect the frame to the stem conductors. Frame components that extend in three dimensions typically require more handling steps or complex automation equipment to complete all welds. Accordingly, it is difficult to automate their assembly and the welding of the individual frame components to each other.

SUMMARY OF THE INVENTION

It is the object of the invention to overcome the above-mentioned disadvantages, and in particular, to provide a high pressure discharge lamp having a pair of arc tubes arranged electrically in parallel with a simplified frame whose assembly may be more readily automated.

According to the invention, a lamp of the kind mentioned in the opening paragraph is for this purpose characterized in that:

the lamp frame supports the arc tubes in a plane parallel with the stem conductors, is welded directly to each of the feed-throughs of the pair of arc tubes and only in a plane co-planar with the stem conductors, and is free of slip-fit connections with the feed-throughs.

As used herein, "co planar" does not require that the welds be in the same plane as the center lines of the stem conductors but only in the same plane as the surface of these conductors. Since all of the welds are in a common plane with the surface of the stem conductors, the frame components and the arc tubes may be more readily held in a jig than the above-mentioned prior art lamps in which the arc tubes were arranged in a plane transverse to the stem leads. The welding electrodes may then also be more easily automated to weld the frame components at high manufacturing speeds at numerous points in the common plane with the stem conductors.

By eliminating the slip-fit connections between the frame and the feed-throughs, and directly welding the frame to each of the feed-throughs, good electrical connection is assured and the additional flexible conductors can be dispensed with. This greatly simplifies the frame and reduces cost by reducing the number of frame parts which must be handled and by reducing the number of welds per feed-through pair by at least two.

It should be noted that U.S. Pat. No. 4,751,432 (Van Delm), U.S. Pat. No. 5,028,845 (Ravi et al) and U.S. Pat. No. 4,689,518 (King) show HID lamps in which a pair of arc tubes are in a plane parallel to the stem conductors. However, these lamps are connected electrically in series which requires that the feed-throughs closest to the stem be connected to a different stem conductor, and the feed-throughs facing away from the stem be connected together. Thus, frames for these lamps lend themselves to positioning the arc tubes in a common plane with the stem conductors because an elongate support rod to establish a return current path is not needed. By contrast, in a parallel connected lamp, the feed-throughs of the adjacent arc tubes are connected to the same stem conductor and an elongate support rod extending the length of the arc tubes must be used to establish a return current path.

According to another embodiment of the invention, the arc tubes are arranged with a first pair of feed-throughs at one end of the arc tubes adjacent each other and facing the lamp stem and with the other pair of feed-throughs adjacent each other and facing away from the stem. An elongate support rod extends from a stem conductor longitudinally past the arc tubes and includes a first end portion disposed between the feed-throughs facing away from the lamp stem. The other stem conductor constitutes a second support rod and includes a second end portion disposed between the pair of feed-throughs facing the stem. A respective metallic transverse support member is welded to each of the end portions and to the respective adjacent feed-throughs, each of the welds being co-planar with the stem conductors.

With a pair of transverse frame members so arranged and directly welded to the feed-throughs a very simple frame construction is obtained.

In this regard, it should be further noted that in series-connected lamps both arc tubes operate simultaneously, and have very similar thermal expansion characteristics. Frame requirements to account for differences in thermal expansion between the two arc tubes in a series lamp are not the same as in a parallel connected lamp. Thus, frame arrangements for series lamps typically cannot be applied directly to parallel lamps.

In yet another embodiment of the invention, at least one but preferably both of the transverse members are resilient for allowing for independent changes in length of the ceramic arc tubes due to thermal expansion during lamp operation. In this way, a long life of the welds at least as long as that of the rated life of the arc tubes is ensured.

The first support rod may be constituted by an elongate stem conductor which extends the length of the arc tubes, in which case no welds between the first support rod and a stem conductor are necessary. However, it has been found that manufacturing a lamp stem with such an elongate stem conductor can be problematic. Accordingly, it is desirable that the stem conductor be short and that the first support rod be welded to this short stem conductor. In that event, it is preferable that the separate first support rod be positioned coplanar with the two stem conductors and welded to the short stem conductor with this weld in a common plane with the welds connecting the transverse members to the end portions of the support rods and each of the feed-throughs.

This is in contrast to the frames of the above-mentioned Dunn and Feuersanger Patents in which the welds were spaced in three dimensions and manual welding was required due to the great difficulty and expense in automating the frame welding.

These and other objects, features, and advantages of the invention will become apparent with reference to the accompanying drawing, detailed description, and claims.

DESCRIPTION OF THE PREFERRED EMBODIMENTS

Figure 1:
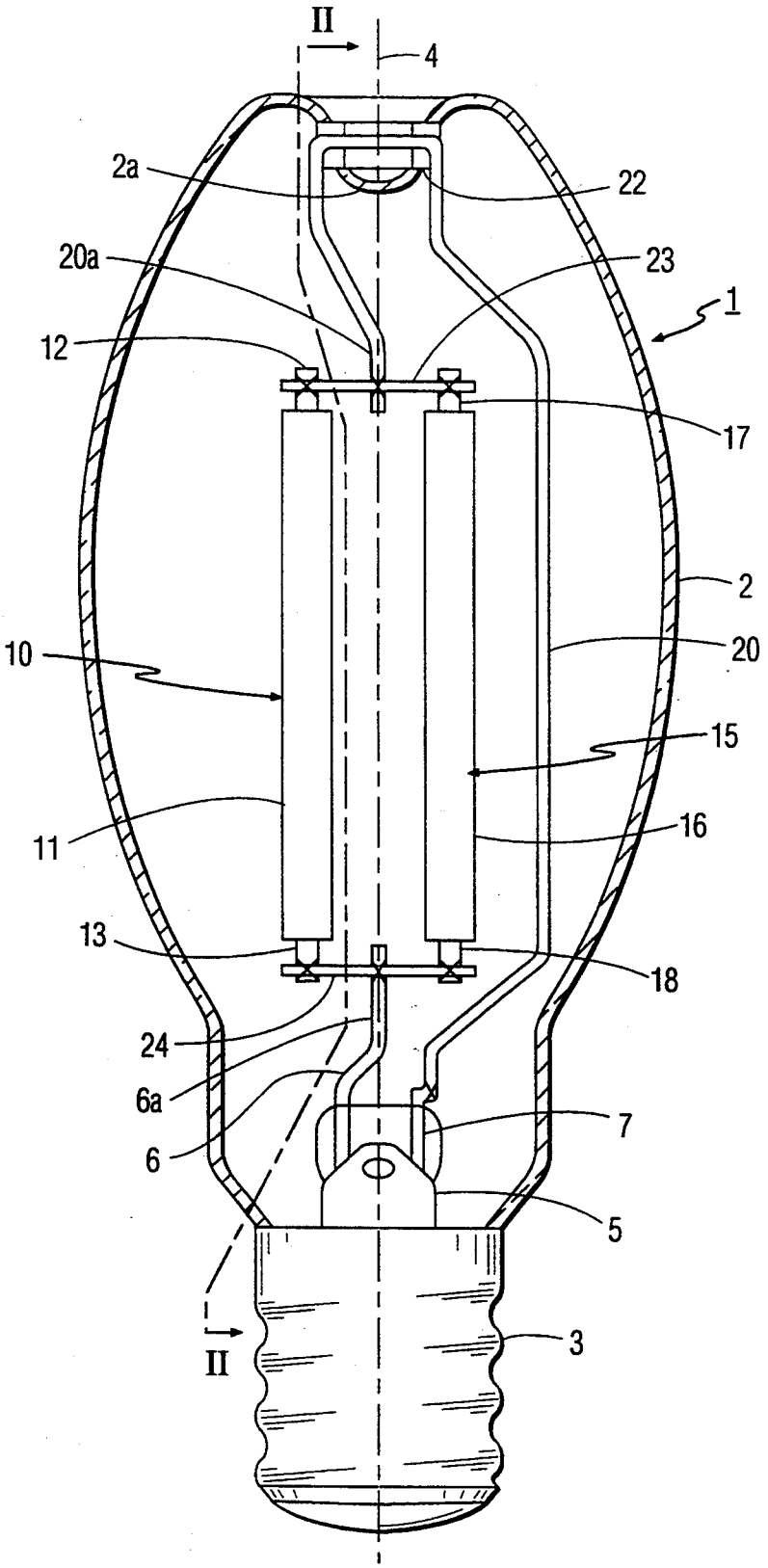
FIG. 1 illustrates a high pressure discharge lamp according to the invention having a simplified frame holding pair of arc tubes connected electrically in parallel.
Figure 2:
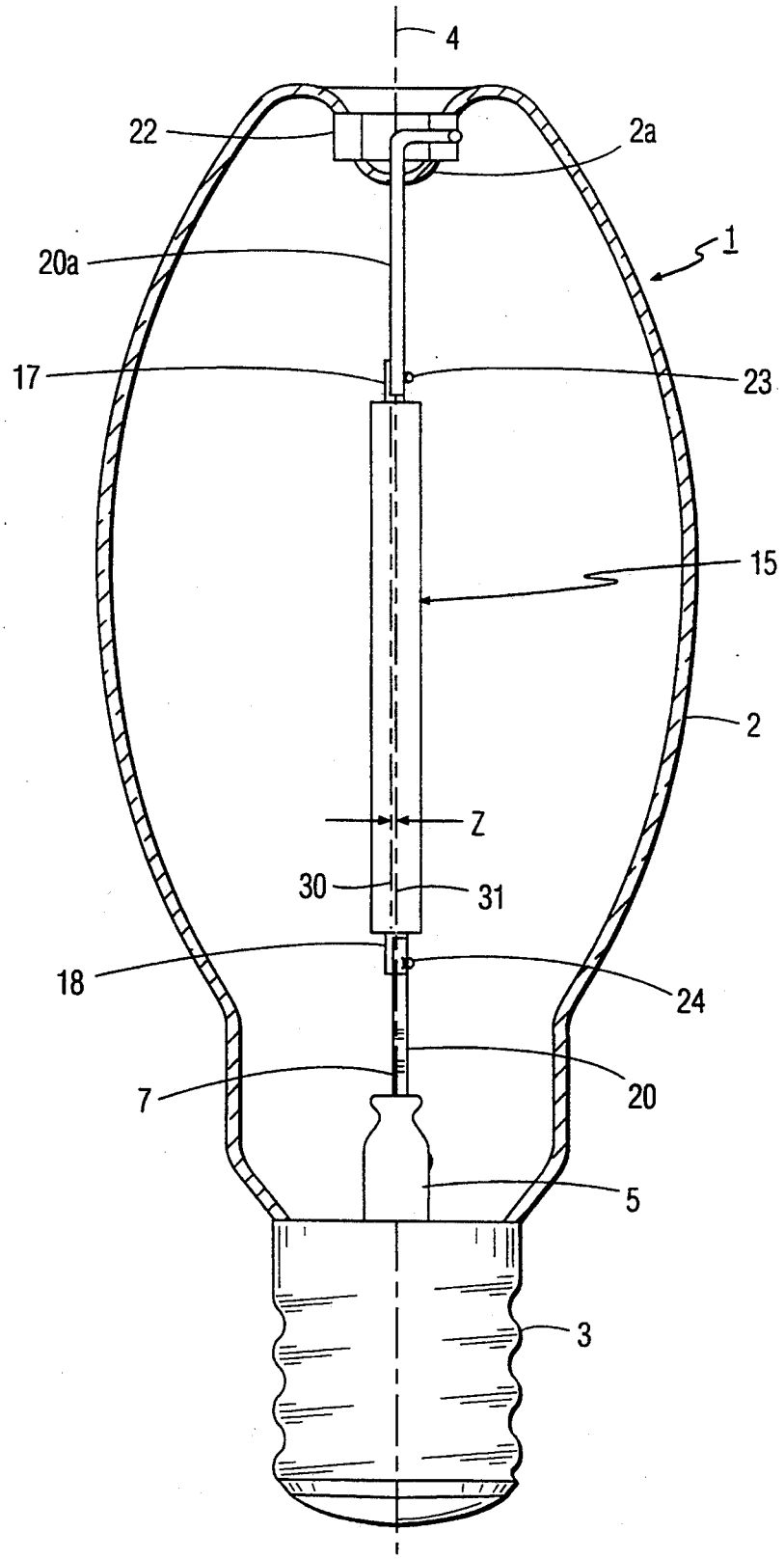
FIG. 2 shows the lamp of FIG. 1 rotated 90 degrees and in cross-section taken on the line II—II.

FIGS. 1 and 2 show a high pressure sodium discharge lamp having an outer lamp envelope 2 defining a longitudinal axis 4. A conventional lamp stem 5 seals the outer envelope in a gas-tight manner and includes a pair of stem conductors 6, 7 extending within said outer envelope in a common plane. The conductors 6, 7 are connected to respective contacts on the screw base 3 in a known manner.

A pair of high pressure sodium arc tubes 10; 15 each include a ceramic body 11; 16 enclosing a discharge space. By ceramic is meant, for example, polycrystalline alumina (PCA) or monocrystalline sapphire, among others. Within the discharge space is a discharge sustaining fill including mercury, sodium and a rare gas such as xenon. The filling may be selected such that the arc tubes are saturated or unsaturated during lamp operation. A pair of niobium feed-throughs 12, 13; 17, 18 extends through opposing ends of each of the arc tubes in a sealed manner and are connected to respective discharge electrodes within the arc tube, not shown.

A metallic frame supports the arc tubes within said outer envelope and electrically connects the arc tubes in parallel. The frame includes a first metallic support rod 20 which is welded to stem conductor 7 and extends the length of the arc tubes to a spring clip 22, which resiliently grasps the inwardly extending dimple **2*a* of the outer envelope. Support rod 20 further includes a first end portion 20*a* extending from spring clip 22 and disposed on the lamp centerline between the feed-throughs 12, 17 which face away from lamp stem 5. The stem conductor 6 constitutes a second metallic support rod and includes a second end portion 6*a* disposed on the lamp centerline between the pair of feed-throughs 13; 18 facing the stem. Metallic transverse support members 23, 24** are welded at their mid-points to a respective end portion and directly to each of the respective pairs of adjacent feed-throughs.

As shown in FIG. 2, the arc tubes are aligned with each other in a plane parallel to the plane defined by the stem conductors 6, 7. Since the niobium feed-throughs are of greater diameter than the support rods 20, 6, the centerlines 30 of the arc tubes are slightly offset from the centerlines 31 of the stem conductors 6, 7 by a distance "z" so that each of the welds (denoted by an "x") connecting the transverse frame members 23, 24 to the first and second end portions **6*a*, 20*a* and to each of the feed-throughs 12, 13; 17, 18** lie in a common plane coplanar with the stem conductors.

During lamp operation, an arc discharge is maintained between the discharge electrodes in only one of the arc tubes because of the parallel electrical connection. One of the arc tubes will be longer than the other, whereas in the inoperative (cold) condition both arc tubes have the same nominal length. In the prior art parallel connected lamps previously mentioned, these length variations were accommodated by a slip fit connection with the feed-throughs at one end of the arc tubes. An additional flexible connecting strap or wire for each arc tube was then required to be welded to the adjacent rigid frame part and the feed-through to ensure good electrical contact. Each strap required two welds, one to the frame part and one to the feed-through. Because of the complex mount structure and the location of the welds in different planes, manual welding by skilled workers was required.

In the lamp according to the invention, the transverse members are directly welded to the feed-throughs and no slip fit connections are used. The additional straps or wires are dispensed with, saving materials costs as well as cost of manual welding. Since the welds between the transverse members and the feed-throughs and the end portions of the support rods are co-planar with the welds between the support rod 20 and stem conductor 7, the welding may be readily and cheaply automated, which reduces lamp cost.

At least one of the transverse frame members is resiliently deformable for allowing independent changes in length of said arc tubes due to thermal expansion during lamp operation. By incorporating resilient deformation, the weld at the mid-point of the transverse member to the end portion of the support rods is subject to less of a twisting moment than if the transverse member was rigid. Alternatively, both of the transverse frame members may be resiliently deformable and of identical dimensions, materials to minimize the number of different frame parts which must be stocked and handled.

Since all of the bends in support rod 20 are in the same plane as the arc tubes, a very flat frame is obtained which may be readily held in a compact jig.

The lamp shown in FIGS. 1, 2 is a 150W HPS lamp, each of the arc tubes being rated at 150W. The arc tubes have walls of polycrystalline alumina and an overall length dimension of 6.9 cm. The stem conductors are nickel having a diameter of 0.16 cm. The support rod 20 is of nickel plated steel and has a diameter of 0.16 cm. The transverse support members are niobium having a diameter of 0.076 cm and a length of 2 cm. During lamp operation, the transverse support members deflected a total distance of about 0.07 cm, accommodating the change in length of the arc tube due to thermal expansion from the off-state of the arc tube. This deflection was found to prevent failure of the welds between the transverse members and the end portions and each of the feed-throughs over a life of about 2000 operating hours with 4000 on/off cycles.

Various modifications to the above-described embodiment may be made. For that the purpose the description is to be understood to be for illustrative purposes only and not limiting. For example,,instead of the first support rod 20 being welded directly to the stem conductor 7, an additional brace may be welded across both of these parts near the stem in the same plane as the other welds.

What is claimed is:

1. A high pressure metal vapor discharge lamp having an outer envelope, a lamp stem sealing said outer envelope in a gas-tight manner and including a pair of stem conductors extending within said outer envelope in a common plane, a pair of arc tubes each having a ceramic wall enclosing a discharge space, a pair of metallic feed-throughs extending from opposing ends thereof, and a discharge sustaining fill within said discharge space, and a metallic lamp frame for supporting said arc tubes within said outer envelope and electrically connecting said arc tubes in parallel, said frame being electrically connected to each of said metallic arc tube feed-throughs, characterized in that:

said frame supports said arc tubes in a plane parallel with said stem conductors, is welded to each of the feed-throughs of the pair of arc tubes only in a plane coplanar with the stem conductors, and is free of slip-fit connections with the feed-throughs.

2. A high pressure discharge lamp according to claim 1, characterized in that said outer envelope defines a longitudinal lamp axis, said arc tubes are arranged longitudinally in said envelope with a first pair of feed-throughs at one end of said arc tubes adjacent each other and facing said stem and with the other pair of feed-throughs adjacent each other and facing away from said stem, said first support rod includes a first end portion disposed between the pair of feed-throughs facing away from said stem, the stem conductor not connected to said first support rod constitutes a second support rod and includes a second end portion disposed between said feed-throughs closest to said stem, and in that a respective metallic transverse support member is welded to each of said end portions and the respective adjacent feed-throughs, each of said welds being co-planar with said stem conductors.

3. A high pressure discharge lamp according to claim 2, characterized in that one of said metallic transverse support members is resilient for allowing independent changes in length of said arc tubes during lamp operation.

4. A high pressure discharge lamp according to claim 3, characterized in that both of said transverse metallic members are resilient.

5. A high pressure discharge lamp according to claim 4, characterized in that said arc tubes are high pressure sodium discharge arc tubes and include a ceramic body enclosing a discharge space and a filling of mercury, sodium, and a rare gas.

6. A high pressure discharge lamp according to claim 3, characterized in that said arc tubes are high pressure sodium discharge arc tubes and include a ceramic body enclosing a discharge space and a filling of mercury, sodium, and a rare gas.

7. A high pressure discharge lamp according to claim 2, characterized in that said arc tubes are high pressure sodium discharge arc tubes and include a ceramic body enclosing a discharge space and a filling of mercury, sodium, and a rare gas.

8. A high pressure discharge lamp according to claim 1, characterized in that said arc tubes are high pressure sodium discharge arc tubes and include a ceramic body enclosing a discharge space and a filling of mercury, sodium, and a rare gas.

9. A high pressure sodium discharge lamp, comprising:

a) an outer envelope defining a longitudinal lamp axis;

b) a lamp stem sealing said outer envelope in a gas-tight manner and including a pair of stem conductors extending within said outer envelope in a common plane;

c) a pair of arc tubes each having a ceramic wall enclosing a discharge space, a discharge sustaining fill within said discharge space including mercury, sodium and a rare gas, and a pair of metallic feed-throughs extending from each end of said arc tubes, said arc tubes being arranged longitudinally within said envelope with the feed-throughs at each end adjacent the feed-through of the other arc tube, one of said pairs of feed-throughs facing said stem and the other pair of feed-throughs facing away from said stem; and d) a metallic frame for supporting said arc tubes within said outer envelope and electrically connecting said arc tubes in parallel, said frame including a first metallic support rod welded to a said stem conductor, said first support rod includes a first end portion disposed between the feed-throughs facing away from to said stem, the stem conductor not welded to said first support rod includes a second end portion disposed between the pair of feed-throughs facing said stem, and a respective metallic transverse support member welded to each of said end portions and the respective adjacent feed-throughs, each of said welds connecting said transverse frame members to said first and second end portions and to each of said feed-throughs being co-planar with said welds connecting said first support rod to its stem conductor, and at least one of said transverse frame members being resilient for allowing independent changes in length of said arc tubes due to thermal expansion during lamp operation.

10. A high pressure sodium discharge lamp according to claim 9, wherein both of said transverse metallic members are resilient.

11. A high pressure sodium discharge lamp according to claim 10, wherein said first support rod extends from its respective stem conductors longitudinally the length of said arc tubes, and said first end portion and said portion extending longitudinally the length of said arc tubes are essentially coplanar with said arc tubes and all of said welds.

12. A high pressure sodium discharge lamp, comprising:

a) an outer envelope defining a longitudinal lamp axis;

b) a lamp stem sealing said outer envelope in a gas-tight manner and including a pair of stem conductors extending within said outer envelope in a common plane;

c) a pair of elongate arc tubes each having a ceramic wall enclosing a discharge space, a discharge sustaining fill within said discharge space including mercury, sodium and a rare gas, and a pair of metallic feed-throughs extending from each end of said arc tubes, said arc tubes being arranged longitudinally within said envelope with the feed-throughs at each end adjacent the feed-through of the other arc tube, one of said pairs of feed-throughs facing said stem and the other pair of feed-throughs facing away from said stem; and d) a metallic frame for supporting said arc tubes within said outer envelope and electrically connecting said arc tubes in parallel, said frame consisting of i) a first metallic support rod welded to a said stem conductor, said first support rod extending from said stem along the entire length of said arc tubes and including a first end portion disposed between said pair of feed-throughs facing away from said stem, ii) a second support rod, constituted by the other stem conductor, and including a second end portion disposed between said pair of feed-throughs facing said stem, and iii) a respective metallic transverse support member welded to each of said support rod end portions and the respective adjacent feed-throughs, each of said welds connecting said transverse frame members to said first and second end portions and to each of said feed-throughs being co-planar with said welds connecting said joining member to said first support rod and said stem conductor, and at least one of said transverse frame members being resilient for allowing independent changes in length of said arc tubes due to thermal expansion during lamp operation.

13. A high pressure sodium discharge lamp according to claim 12, wherein both of said transverse metallic members are resilient.

14. A high pressure sodium discharge lamp according to claim 13, wherein said support rods are essentially coplanar with said arc tubes and all of said welds.

15. A high pressure sodium discharge lamp according to claim 12, wherein said first support rod is essentially coplanar with said arc tubes and all of said welds.

* * * * *